US007395757B1

(12) United States Patent
Baghdoian

(10) Patent No.: US 7,395,757 B1
(45) Date of Patent: Jul. 8, 2008

(54) WASTE COMPACTOR

(76) Inventor: Sossy L. Baghdoian, 9516 Oso Ave., Chatsworth, CA (US) 91311

( * ) Notice: Subject to any disclaimer, the term of this patent is extended or adjusted under 35 U.S.C. 154(b) by 0 days.

(21) Appl. No.: 11/978,078

(22) Filed: Oct. 26, 2007

Related U.S. Application Data

(60) Provisional application No. 60/959,604, filed on Jul. 16, 2007.

(51) Int. Cl.
*B30B 1/04* (2006.01)
*B30B 15/04* (2006.01)
*B30B 15/06* (2006.01)

(52) U.S. Cl. ..... 100/226; 100/228; 100/229 A; 100/233; 100/245; 100/265; 100/295; 100/902; 220/908

(58) Field of Classification Search ..... 100/226, 100/227, 228, 229 A, 233, 240, 245, 246, 100/252, 255, 265, 293, 295, 902; 53/527; 220/260, 262, 263, 323, 908; 241/99, 270
See application file for complete search history.

(56) References Cited

U.S. PATENT DOCUMENTS 2,423,209 A * 7/1947 Storey ..... 100/245
3,077,827 A 2/1963 Bunke et al.
4,002,387 A 1/1977 Wolbrink
4,108,065 A 8/1978 Unger
4,240,341 A 12/1980 Whipple et al.
4,483,248 A 11/1984 Ostreng
4,703,611 A * 11/1987 Young ..... 53/529
5,048,413 A 9/1991 Deiters
5,078,060 A * 1/1992 Martin ..... 100/218
5,090,309 A * 2/1992 Lai ..... 100/226
5,642,661 A 7/1997 Tu
6,138,558 A 10/2000 Harrington

* cited by examiner

*Primary Examiner*—Jimmy T Nguyen
(74) *Attorney, Agent, or Firm*—Sandy Lipkin

(57) ABSTRACT

A system and apparatus for crushing aluminum cans, plastic containers and other crushable waste that is manual and portable. On the underside of the lid to the apparatus is a detachable handle with a plate attached thereto that has a series of rough ridges. The handle can descend down the height of the apparatus through a pair of parallel channels located down the front and rear of the apparatus. At the bottom of the apparatus on the interior is a mating plate that has a second series of rough edges that fit like a zipper with the ridges of the top plate for crushing of waste. The handle is lockable through latches to the lid of the apparatus when not in use. A second lock holds the handle in place on the rear of the apparatus when not in use. The bottom of the apparatus has one or more pairs of wheels to allow for easy portability.

4 Claims, 5 Drawing Sheets

WASTE COMPACTOR

REFERENCE TO PRIOR APPLICATION

This application claims the priority of provisional application 60/959,604, filed Jul. 16, 2007 entitled CAN CRUSHER by Sossy Baghdoian.

BACKGROUND OF THE INVENTION

1. Field of the Invention

The present invention relates generally to the field of waste management and specifically toward a device that compacts crushable waste into a smaller space.

2. Description of the Prior Art

Trash compactors are known in the art as a way to make waste take up smaller space and to manage waste. However, these devices are often expensive, complicated and require the use of electricity, which in itself leaves an impact on the environment. Furthermore, many trash compactors do not separate recyclable waste from general waste.

It is the object of the present invention to provide an apparatus and method for managing crushable, recyclable waste that is adaptable for home or office use, that can stand alone or be part of a regular trash receptacle, that does not use electricity and is easy to use.

SUMMARY OF THE INVENTION

The preferred embodiment of the present invention teaches an apparatus for compacting crushable items comprising a main body portion for receiving the crushable items. The main body portion further comprises a base; one or more sidewalls that in combination create a front portion, a rear portion and side portions extending upward from the base portion and creating an empty interior portion; a first channel running down the face of the front portion; and a second channel running down the face of the rear portion; a first planar surface having a top portion and a bottom portion situated above the base in the interior portion of the main body portion; a first multiplicity of ridges extending upward from the top portion of the first planar surface; a lid connected to the rear portion of the main body portion through one or more hinges, the lid having a top portion and a bottom portion; one or more latches extending downward from the bottom portion of the lid; a handle that is releasably attached to the bottom portion of the lid through the latches; a second planar surface having a top portion and a bottom portion situated substantially parallel to the lid and attached to the handle; a second multiplicity of ridges extending downward from the second planar surface, the second multiplicity of ridges fitting like a zipper when pressed against the first multiplicity of ridges; and a locking mechanism connected to the handle positioned on the rear portion of main body portion.

The embodiment above can be further modified by defining that the portion has one or more sets of wheels attached thereto.

The embodiment above can be further modified by defining that the locking mechanism connected to the handle positioned on the rear portion of the main body portion further comprises a main locking body portion having a bottom side, a top side, a back side, a front side and two sidewalls; a groove in the main locking body portion for receiving the handle; a securing rod having a first end and second end that crosses through each of the sidewalls and that secures the handle in the groove; and one or more latches attached to the rear portion of the main body portion for attachment to one or both of the first end and second of the rod.

The embodiment above can be further modified by defining that the first and second channels are kept closed through sidewalls composed of a stiff rubber that is displaceable when the handle is manually forced therethrough.

The instant invention is an apparatus that crushes aluminum cans, plastic containers and other crushable recyclable waste. The device cannot crush glass, but is ideal for aluminum and plastic and any other crushable, recyclable materials that are ready to be discarded.

The system involves the use of a receptacle that is portable because it has wheels that allow for portability and the ability of the apparatus to either stand alone or attach to a separate trash receptacle for the collection of regular, non-recyclable waste. The apparatus has an interior portion for the collection of the crushable, recyclable waste. The receptacle has a lid with an underside that has attachable thereto a handle that is securable to the lid through a pair of latches. Attached to the handle is a planar portion that has a series of rough ridges on its bottom plane.

At the bottom interior portion of the receptacle is a similar series of rough ridges that cooperate with the top set of rough ridges in a way that creates a crushing middle as the top series of rough ridges mate and fit into the bottom set of rough ridges.

The handle is grasped by the user after a crushable item has been placed in the interior portion. The handle, held in the latches and to a lock on the rear of the apparatus when not in use, is disengaged from the latches and lock. A first channel located down front of the apparatus has a corresponding second channel located down the back of the apparatus. These channels allow the handle to travel down the length of the apparatus during crushing.

Once crushing is complete, the handle travels back up the interior portion of the apparatus with the extending portions traveling through the channels at which point the handle can be re-latched into the latches and re-locked in the rear lock for storage until the next use.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
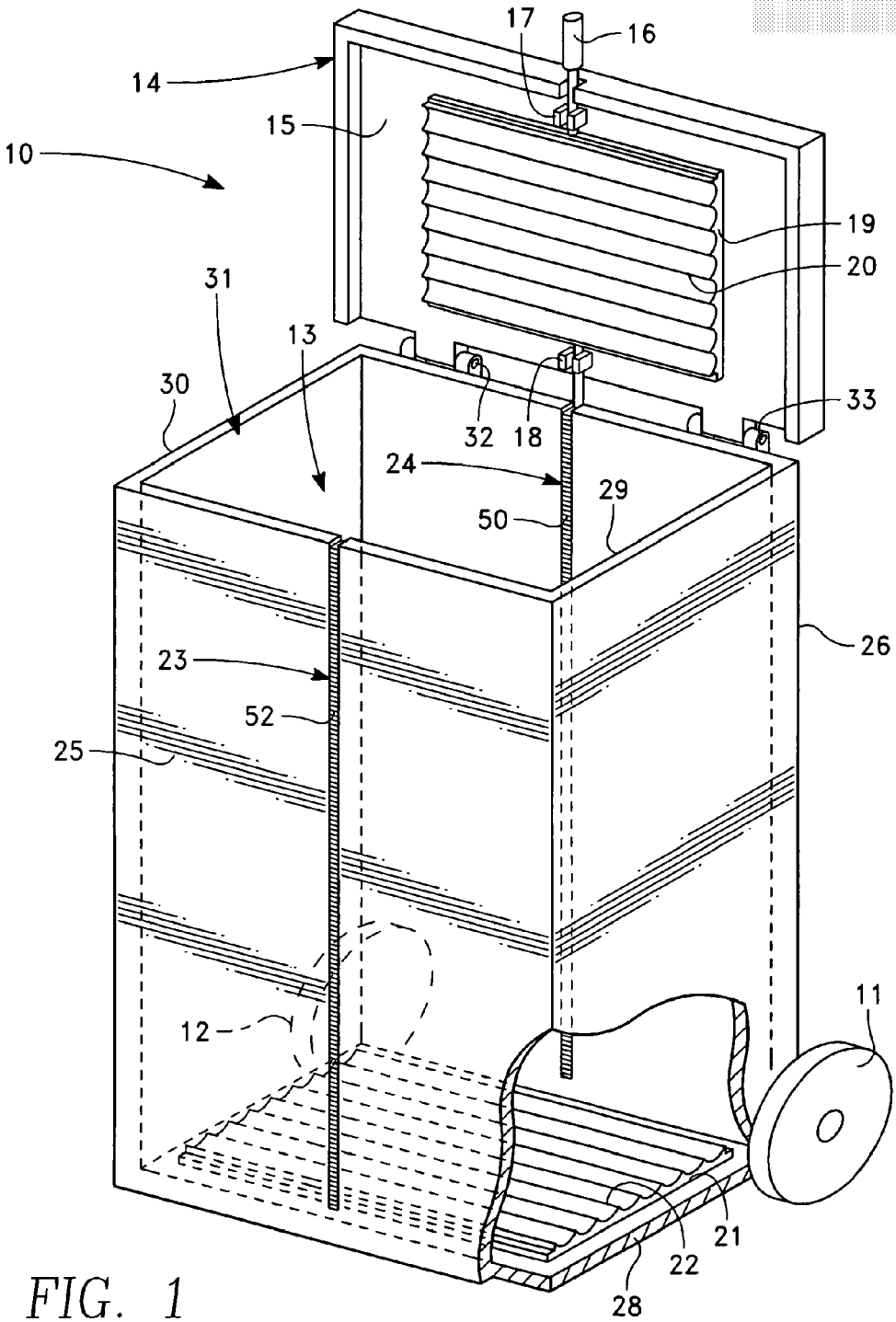
FIG. 1 is a perspective view of the invention with the interior and rear portions shown in phantom except at the cut-out.

Turning to the drawings, the preferred embodiment is illustrated and described by reference characters that denote similar elements throughout the several views of the instant invention.

FIG. 1 shows most of the features of the invention. The receptacle 10 is shown as a substantially cubic shaped container, but it is to be understood that the invention is not limited to this specific shape. The container has a bottom base 28, a front wall 25, a rear wall 26 and two sidewalls 29, 30. The top portion is an opening 31 allowing for the placement of crushable matter into the interior portion 13 of the apparatus 10.

The front wall 25 has a closeable channel 23 that runs the height of the apparatus 10. The rear wall 26 has a similar channel 24.

Both channels 23, 24 contain stiff rubber 52, 50 that is displaceable when the handle 16 is manually forced therethrough. Both channels 23, 24 are composed of a stiff rubber that allows for it to stay closed when not in use, but that will be forced open upon pressure being applied through the moving of the handle 16 down the channels 23, 24.

Attached substantially at the top of the rear wall 26 is a lid 14. The lid 14 is connected to the apparatus 10 through a pair of hinges 32, 33. The hinges 32, 33 allow the lid to be easily moved from the closed position to the open position. On the underside of the lid 14 are two latches 17, 18 that hold the handle 16 in place when not in use. Attached to the handle 16 is a planar top portion 19 of the crushing portion of the device. This planar top portion 19 contains a series of rough ridges 20 that fit like teeth into a mating series of ridges 22 found on the bottom of the interior portion 13 of the apparatus 10. The bottom of the device has one or more pairs of wheels 11, 12 that allow for easy portability.

Figure 2:
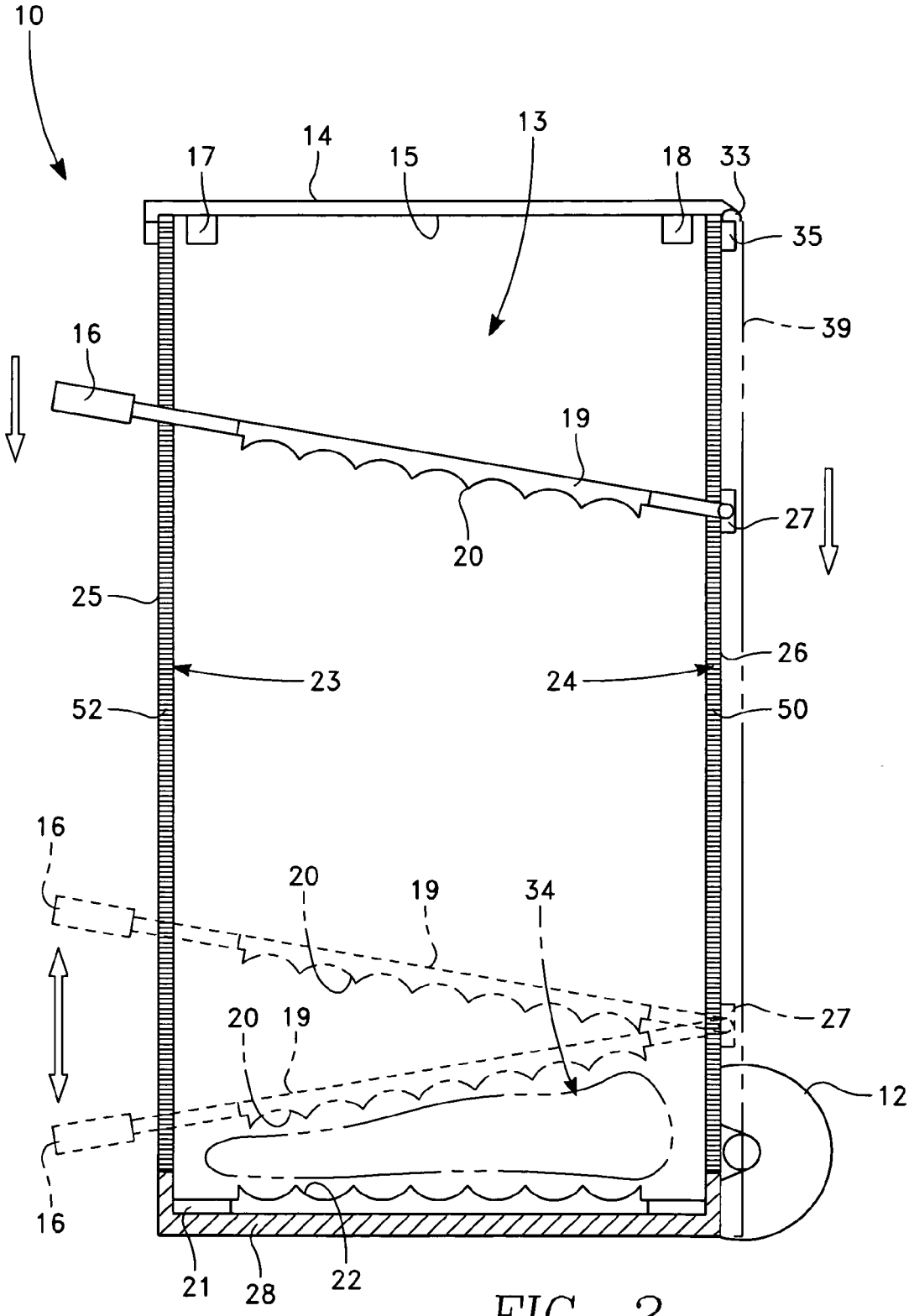
FIG. 2 is a side view with the interior portions shown in phantom.

FIG. 2 shows how the crushing portion of the apparatus 10 operates. The handle 16 travels the height of the device 10 through manual force, once the handle 16 has been freed from the latches 17, 18 on the underside of the lid 14 as well as the lock 27 on the back 26 of the apparatus 10 through the channels 23, 24 that are easily seen in FIG. 1. Once the handle 16 reaches the bottom of the interior portion 13 of the apparatus 10, the top series of ridges 20 crushes the crushable item 34 against the bottom series of ridges 22.

Figure 3:
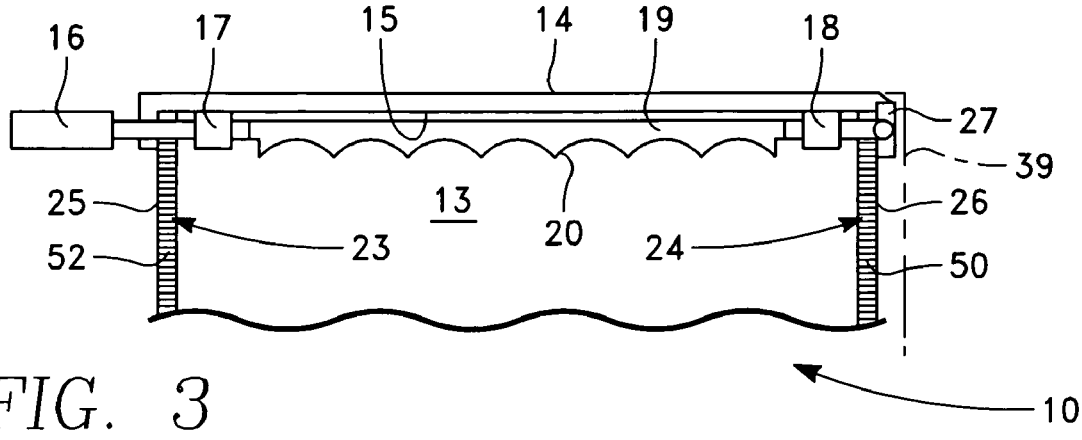
FIG. 3 is a cross-sectional view of the handle and lid portion at the top of the invention showing the lid in a closed position.
Figure 4:
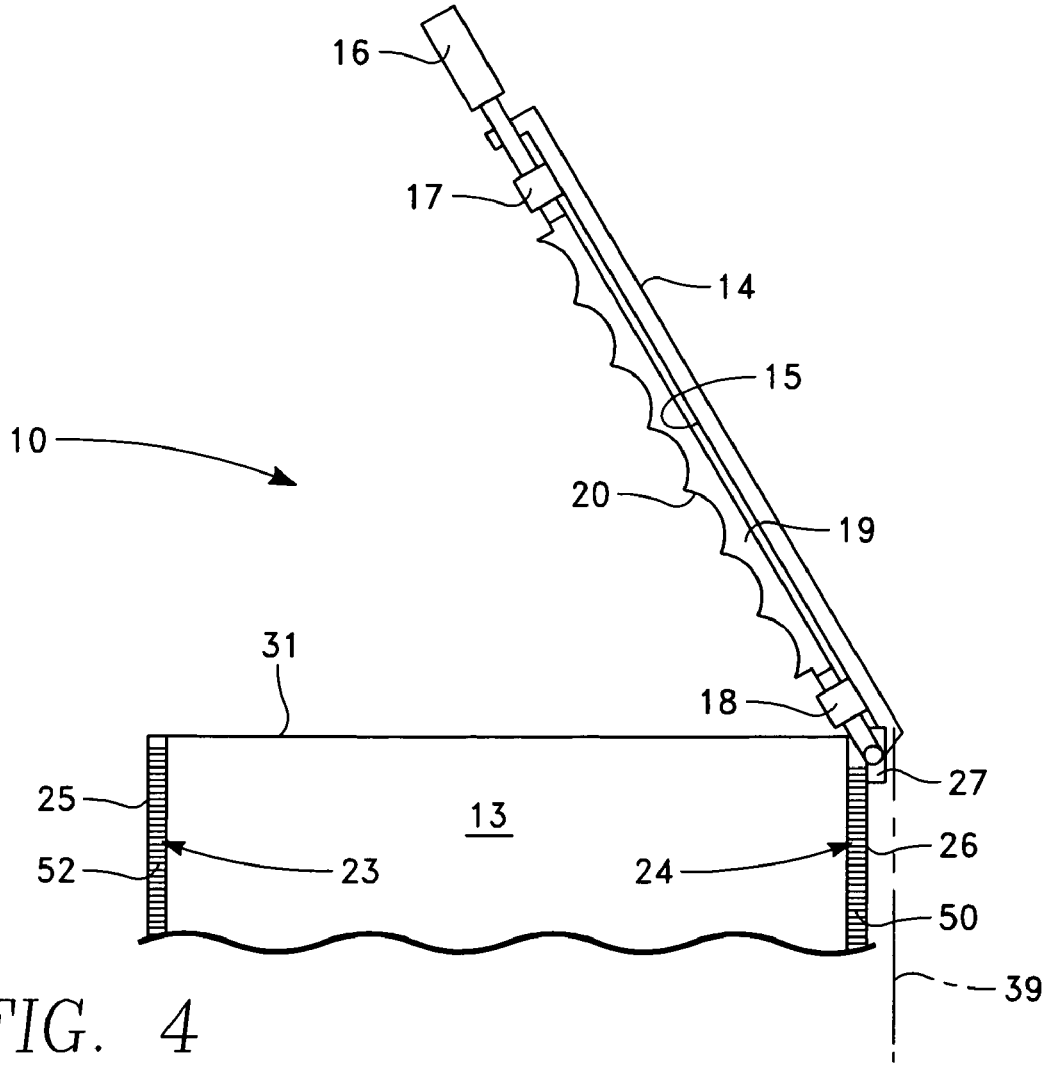
FIG. 4 is a cross-sectional view of the handle and lid portion of the top of the invention showing the lid in an open position.

FIG. 3 shows the handle 16 in side view as it is held in place by the latches 17, 18 as well as the rear lock 27. FIG. 4 shows the same configuration of the handle 16 as FIG. 3, but with the lid 14 open, thereby allowing for the dropping of a crushable item 34 into the interior portion 13 of the apparatus 10.

Figure 5:
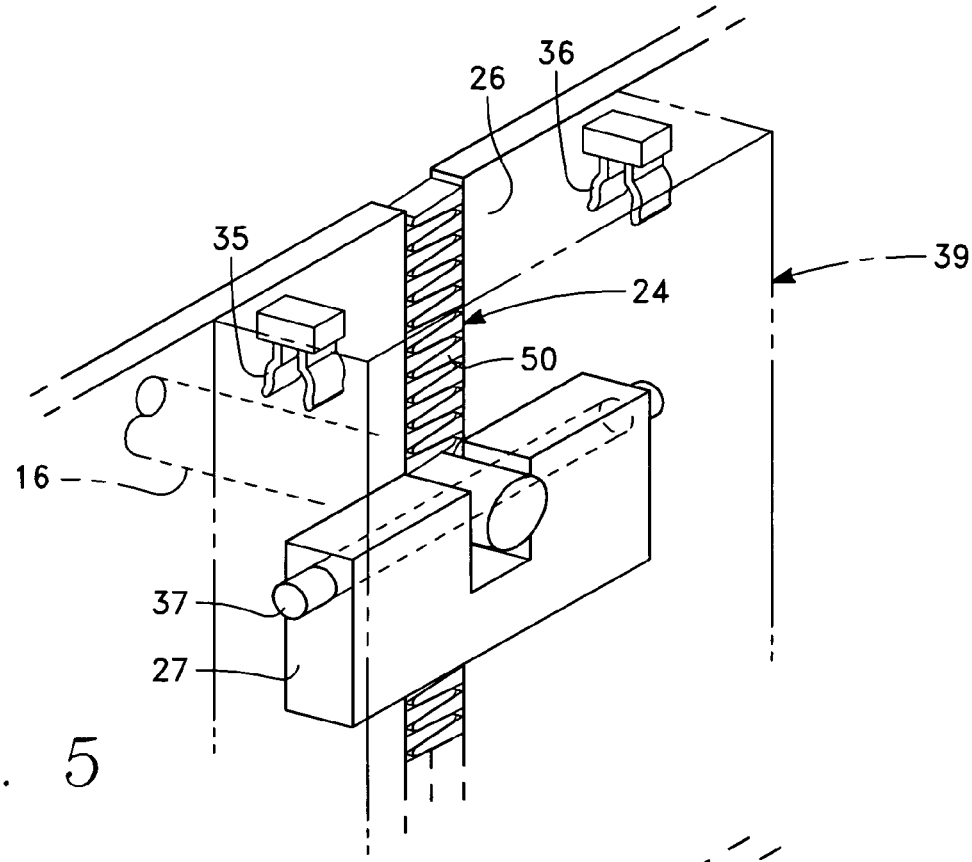
FIG. 5 is a close up view of the lock located on the back of the invention with the handle unlatched.
Figure 6:
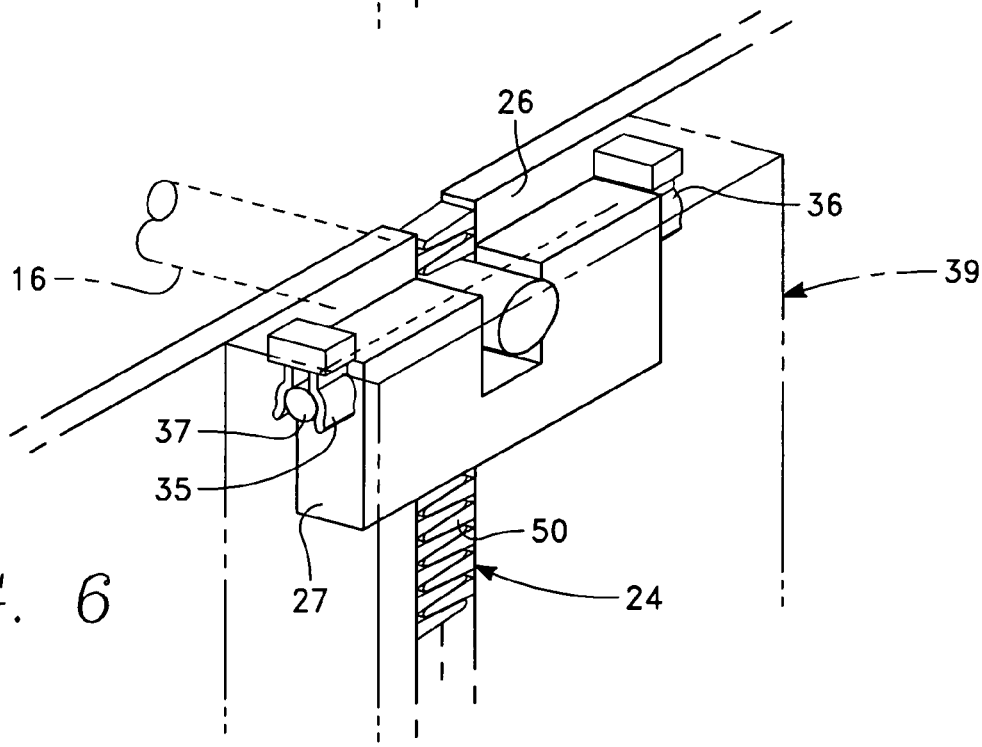
FIG. 6 is a close up view of the lock located on the back of the invention with the handle latched.

FIG. 5 shows a close up view of the rear lock 27 with the handle 16 not engaged. The lock 27 as shown in this figure is another pair of latches 35, 36 that attach to a rod 37 that holds the handle 16 in place in the lock 27. FIG. 6 shows a close up view of the rear lock 27 with the handle 16 engaged through the locking of the lock 27 into the latches 35, 36. As seen in FIGS. 2-6, there is a cover 39 that is situated down the back 26 of the apparatus 10 that conceals the rear channel 24.

Figure 7:
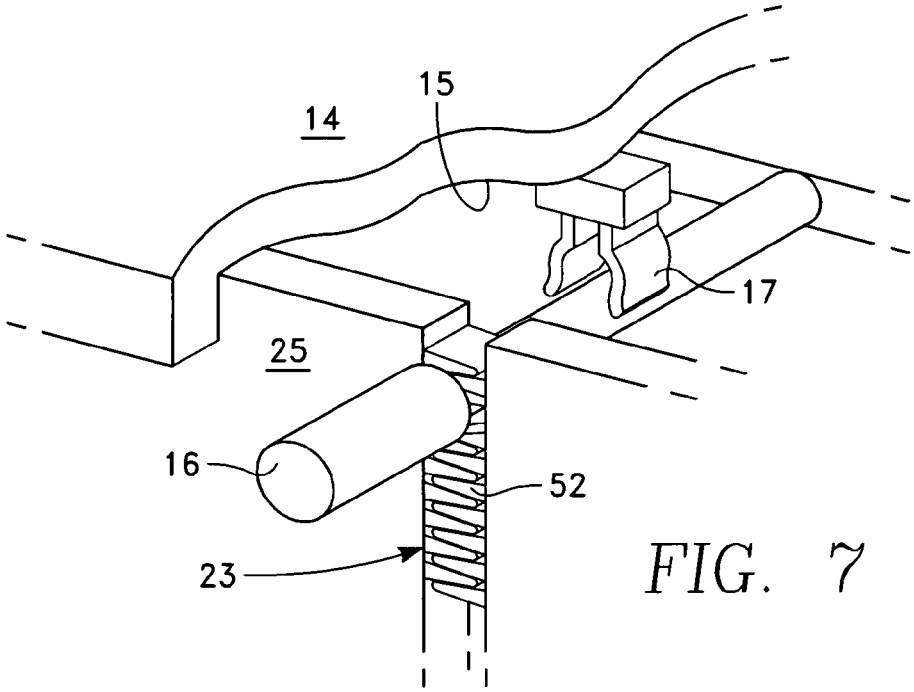
FIG. 7 is a close up view of the handle and front latch located at the front of the invention with the handle unlatched.
Figure 8:
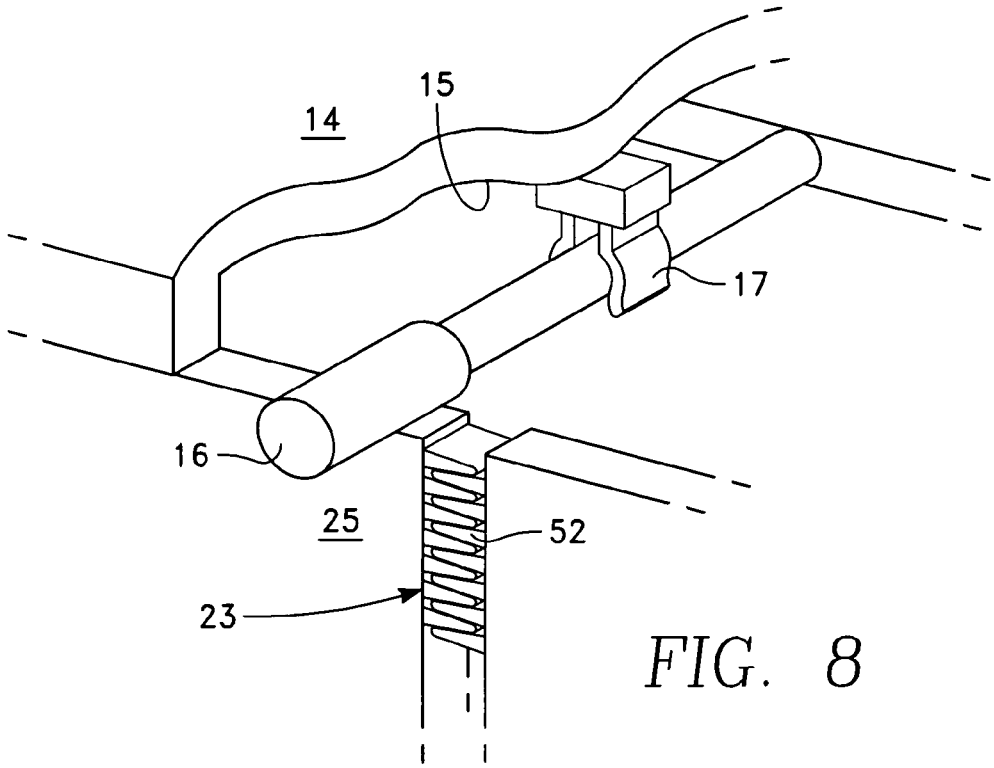
FIG. 8 is a close up view of the handle and front latch located at the front of the invention with the handle latched.

Likewise, FIG. 7 shows the front of the handle 16 disengaged with one of the front latches 17 found under the lid 14, while FIG. 8 shows the front of the handle 16 engaged with one of the front latches 17 found under the lid 14.

An alternate embodiment of the invention allows for the apparatus 10 to be attached to a regular trash can.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

REFERENCE NUMERALS

10 can crushing apparatus
11, 12 wheels
13 interior portion
14 lid
15 underside of lid
16 handle
17, 18 front latches
19 top planar portion
20 top rough ridges
21 bottom planar portion
22 bottom rough ridges
23 front channel
24 rear channel
25 front wall
26 back wall
27 rear lock
28 bottom base
29, 30 sidewalls
31 open top
32, 33 hinges
34 crushable item
35, 36 rear latches
37 rod
39 rear channel cover
50 stiff rubber, rear channel
52 stiff rubber, front channel

What is claimed is:

1. An apparatus for compacting crushable items comprising a main body portion for receiving said crushable items said main body portion further comprising a base;

one or more sidewalls that in combination create a front portion, a rear portion and side portions extending upward from said base portion and creating an empty interior portion;

a first channel running down the face of said front portion; and a second channel running down the face of said rear portion;

a first planar surface having a top portion and a bottom portion situated above said base in said interior portion of said main body portion;

a first multiplicity of ridges extending upward from said top portion of said first planar surface;

a lid connected to said rear portion of said main body portion through one or more hinges, said lid having a top portion and a bottom portion;

one or more latches extending downward from said bottom portion of said lid;

a handle that is releasably attached to said bottom portion of said lid through said latches;

a second planar surface having a top portion and a bottom portion situated substantially parallel to said lid and attached to said handle;

a second multiplicity of ridges extending downward from said second planar surface, said second multiplicity of ridges fitting like a zipper when pressed against said first multiplicity of ridges; and a locking mechanism connected to said handle positioned on said rear portion of said main body portion.

2. An apparatus as defined in claim 1 wherein said base portion has one or more sets of wheels attached thereto.

3. An apparatus as defined in claim 1 wherein said locking mechanism connected to said handle positioned on said rear portion of said main body portion further comprises a main locking body portion having a bottom side, a top side, a back side, a front side and two sidewalls;

a groove in said main locking body portion for receiving said handle;

a securing rod having a first end and second end that crosses through each of said sidewalls and that secures said handle in said groove; and one or more latches attached to said rear portion of said main body portion for attachment to one or both of said first end and said second end of said rod.

4. An apparatus as defined in claim 1 wherein said first and second channels are kept closed through sidewalls composed of a stiff rubber that is displaceable when said handle is manually forced therethrough.

* * * * *